US010800011B2

(12) United States Patent
Herisse

(10) Patent No.: US 10,800,011 B2
(45) Date of Patent: Oct. 13, 2020

(54) WRENCH WITH A RATCHET MECHANISM

(71) Applicant: STANLEY MIDDLE EAST FZE, Dubai (AE)

(72) Inventor: Jean Christophe Herisse, Savigny sur Orge (FR)

(73) Assignee: Stanley Black & Decker MEA FZE, Jebel Ali, Dubai (AE)

( * ) Notice: Subject to any disclaimer, the term of this patent is extended or adjusted under 35 U.S.C. 154(b) by 261 days.

(21) Appl. No.: 15/608,676

(22) Filed: May 30, 2017

(65) Prior Publication Data

US 2017/0341206 A1 Nov. 30, 2017

(51) Int. Cl.
*B25B 13/46* (2006.01)

(52) U.S. Cl.
CPC ..... *B25B 13/461* (2013.01); *B25B 13/462* (2013.01); *B25B 13/465* (2013.01)

(58) Field of Classification Search
CPC ... B25B 13/461; B25B 13/462; B25B 13/465; B25B 15/04; B25B 13/468; B25B 13/46
USPC ..... 81/61, 62, 63
See application file for complete search history.

(56) References Cited

U.S. PATENT DOCUMENTS 6,164,167 A * 12/2000 Chen ..... B25B 13/463 81/63
2006/0027049 A1* 2/2006 Arnold ..... B25B 13/463 81/60
2007/0277652 A1* 12/2007 Tuan-Mu ..... B25B 13/06 81/63
2009/0301266 A1* 12/2009 Hu ..... B25B 13/465 81/62

* cited by examiner

*Primary Examiner* — David B. Thomas
*Assistant Examiner* — Aaron R McConnell
(74) *Attorney, Agent, or Firm* — Caeden Drayton; Adan Ayala

(57) ABSTRACT

A ratchet wrench comprising a ratchet head with a cylindrical bore having a central axis; a handle; a drive member (26) with a rotation axis (W-W) retained within the cylindrical bore for rotation about the central axis; and a toothed ratchet pawl (42); a cylindrical array of straight ratchet teeth arranged about one of the cylindrical bore or the drive member; and a pawl recess (36) arranged to support the pawl. The pawl may mesh with the ratchet teeth for transmission of rotation of the handle in a first direction to the drive member about the rotation axis or disengage from the ratchet teeth to decouple rotation of the handle in a second direction from the drive member. Support (37*a*, 37*b*, 46, 48, 50) for the pawl in the recess is shaped to accommodate divergence between the central axis and the rotation axis.

7 Claims, 13 Drawing Sheets

WRENCH WITH A RATCHET MECHANISM

The present invention relates to wrenches with a ratchet mechanism. The present invention relates in particular to a pawl for a ratchet mechanism. This patent application claims priority to GB Application No. 1609500.2, filed May 31, 2016 which is hereby incorporated by reference in its entirety.

A wrench with a ratchet mechanism typically comprises a head wherefrom a handle extends. The head is formed with an inner cylindrically bore. The bore houses a coaxially located drive member which is free to rotate in respect of head about a common axis. The drive member is axially retained to the body. A drive spindle for engagement with a socket, or similar accessory tool, extends from the drive member.

The drive element may be adapted to receive a toothed pawl. Opposite ends of the toothed pawl may mesh alternately, according to the operating position selected for the pawl, with teeth arranged around the inner cylindrical face of the bore. Torque imparted by the handle to the head is transmitted to the drive member in one direction of rotation, say a clockwise direction, while in the anti-clockwise direction of rotation the pawl and bore teeth can slide over each other without meshing with each other. The pawl may be held in its operating position by a switching element. Alternatively, the switching element may move the pawl to an operating position where torque imparted by the handle to the head is transmitted to the drive member in the anti-clockwise direction, while in the clockwise direction of rotation the pawl and bore teeth can slide over each other without meshing with each other.

Wrenches with similar ratchet mechanisms beneficially conserve effort and have been in use for many years. U.S. Pat. No. 3,677,102 discloses one such wrench. Whilst this wrench may be suitable for use in high torque applications, twisting caused by routine use may cause misalignment of its internal components and, over time, may result in premature wear.

US patent publication No. 2006/0027049 acknowledges these potential shortcomings. It discloses a wrench comprising a ratchet mechanism where the head is formed with an inner cylindrically smooth bore. The bore houses a coaxially located drive member in the form of a ring with teeth on its outer circumference and an inner profile for engagement with a nut, bolt or screw. The drive member is free to rotate in respect of head about a common axis. The drive member is axially retained to the body.

The body is adapted to receive a toothed pawl. An end of the toothed pawl may mesh with the toothed drive member when the pawl is in its operating position. Torque imparted by the handle to the head is transmitted to the drive member in a clockwise direction, as viewed from its upper side, while in the anti-clockwise direction of rotation the pawl and bore teeth can slide over each other without meshing with each other. The pawl is biased towards its operating position by a spring element. Operation of the ratchet mechanism may be reversed by turning the head over so as the lower side of the drive member is uppermost on the nut, bolt or screw.

The teeth do not extend straight from the top to the bottom of the drive member in an axial direction. Instead, the drive member's outer circumference is concave and its teeth extend axially between the top and bottom of the ring-shaped drive member in an inward curve. The drive member teeth curve outward toward its top and bottom edges. The pawl teeth are formed in a correspondingly convex shape so that the pawl teeth extend, in an axial direction, between the top and bottom of the pawl in an outward curve to mesh with the drive member teeth.

The radius of the arc defined by the concave drive member teeth is equal to, or slightly greater than, the radius of the arc defined by the convex pawl teeth. This allows for the effects of manufacturing tolerances in the alignment of the drive member and pawl teeth, and for the effects of twisting deformation of the drive member, in relation to the wrench body, under high torque loads. Arcuate teeth may be more complex to manufacture than straight teeth. This additional complexity may increase costs.

According to a first aspect of the invention, there is provided a ratchet wrench comprising: a ring-shaped ratchet head with a cylindrical bore having a central axis; a handle coupled to the ratchet head for movement therewith; a drive member with a rotation axis retained in the cylindrical bore for rotation about the central axis; and a toothed ratchet pawl; a cylindrical array of straight ratchet teeth arranged about one of the cylindrical bore or the drive member and parallel to the axis thereof; and a pawl recess arranged to support the pawl for either: meshed engagement with the ratchet teeth for transmission of rotation of the handle about the central axis in a first direction to the drive member about the rotation axis; or disengagement from the ratchet teeth to decouple rotation of the handle about the central axis in a second direction opposite to the first direction from the drive member and wherein support for the pawl in the recess is shaped to accommodate divergence between the central axis and the rotation axis. The support may be curved in shape, or have a substantially curved profile, which is relatively routine for moulding, machining or sintered manufacturing processes. Advantageously, it allows use of straight pawl and ratchet teeth whilst also allowing a degree of relative movement between the pawl and the drive member. This may compensate for any geometric manufacturing inaccuracies and/or tilting movement of the drive member which may cause misalignment between rotation axis of the drive member and the central axis of the ratchet head. This may diminish wear at the interfaces between the ratchet and the pawl teeth, on the one hand, and the pawl and the pawl recess, on the other hand, whilst maintaining satisfactory ratcheting operation of the ratchet wrench.

The pawl may comprise at least one straight pawl tooth for meshed engagement with the ratchet teeth. Preferably, the pawl comprises an array of straight pawl teeth for meshed engagement with the ratchet teeth. The plurality of teeth of the pawl enhances engagement with the ratchet teeth. Preferably, the array of pawl teeth defines an arc having the substantially the same radius as the cylindrical array of straight ratchet teeth. Similarity between the arrays of pawl teeth and ratchet teeth further enhances engagement between the teeth.

Preferably, support for the pawl comprises planar surfaces on one of the pawl or the recess and substantially domed surface on the other of the pawl or the recess. Preferably, the recess comprises a planar recess back and a planar recess seat arranged substantially orthogonal to the recess back. These are routine shapes which may jointly, or severally, help to reduce manufacturing costs.

Preferably, the drive member comprises the recess. The recess may be moulded or machined into the drive member as part of its manufacturing process.

Preferably, the pawl comprises the substantially domed surface. The domed surface may be moulded or machined onto the pawl as part of its manufacturing process. Preferably, the domed surface comprises at least one at least partially convex pawl surface arranged to accommodate tilt between the pawl and the recess.

Preferably, the at least one at least partially pawl surface comprises a partially convex rear pawl surface with partially planar cheeks arranged to stabilise meshed engagement between the pawl and the ratchet teeth in a plane normal to the rotation axis. The planar profile of the rear pawl cheeks may contact the planar recess in a way that positively encourages meshed engagement between the pawl and the ratchet teeth. The non-planar portions of the rear pawl surface are convex.

Preferably, the at least one pawl surface comprises a convex lower pawl surface intermediate the rear pawl surface and the at least one straight pawl tooth. Preferably, the least one pawl surface comprises a convex upper pawl surface on an opposite side of the pawl to the lower pawl surface. The convex lower pawl surface, the convex upper pawl surface and/or the non-planar portions of the rear pawl surface contribute to accommodation of divergence between the central axis and the rotation axis.

The ratchet wrench may be a reversible ratchet wrench comprising a manually operable switching member coupled to the pawl for selective orientation of the pawl between: a first orientation wherein the pawl is arranged to mesh with the ratchet teeth when the handle is rotated about the central axis in the first direction thereby transmitting first direction rotation to the drive member and wherein the pawl is arranged to ride over the ratchet teeth when the handle is rotated about the central axis in the second direction thereby disengaging the drive member from second direction rotation of the handle; and a second orientation wherein the pawl is arranged to mesh with the ratchet teeth when the handle is rotated about the central axis in the second direction thereby transmitting second direction rotation to the drive member and wherein the pawl is arranged to ride over the ratchet teeth when the handle is rotated about the central axis in the first direction thereby disengaging the drive member from first direction rotation of the handle.

Preferably, the bore is sealed by a seal arranged between the switching member and the head. The seal improves resistance to ingress of dirt into the cylindrical bore which would otherwise impair performance over time. However, resilience in the seal may allow relative movement between the drive member and the head. Advantageously, the ability to accommodate of divergence between the central axis and the rotation axis may allow use of the seal without impairment to satisfactory ratcheting operation of the ratchet wrench.

Preferably, the switching member is releasably retained in either of the first or second orientations of the pawl. This may avoid accidental deselection of the first or second orientations of the pawl.

Preferably, the drive member comprises a drive spindle for connection to an accessory tool. Alternatively, the drive member may be a closed ring shaped to surround a nut or bolt head.

An embodiment of the invention shall now be described with reference to the accompanying drawings of which:

Figure 1:
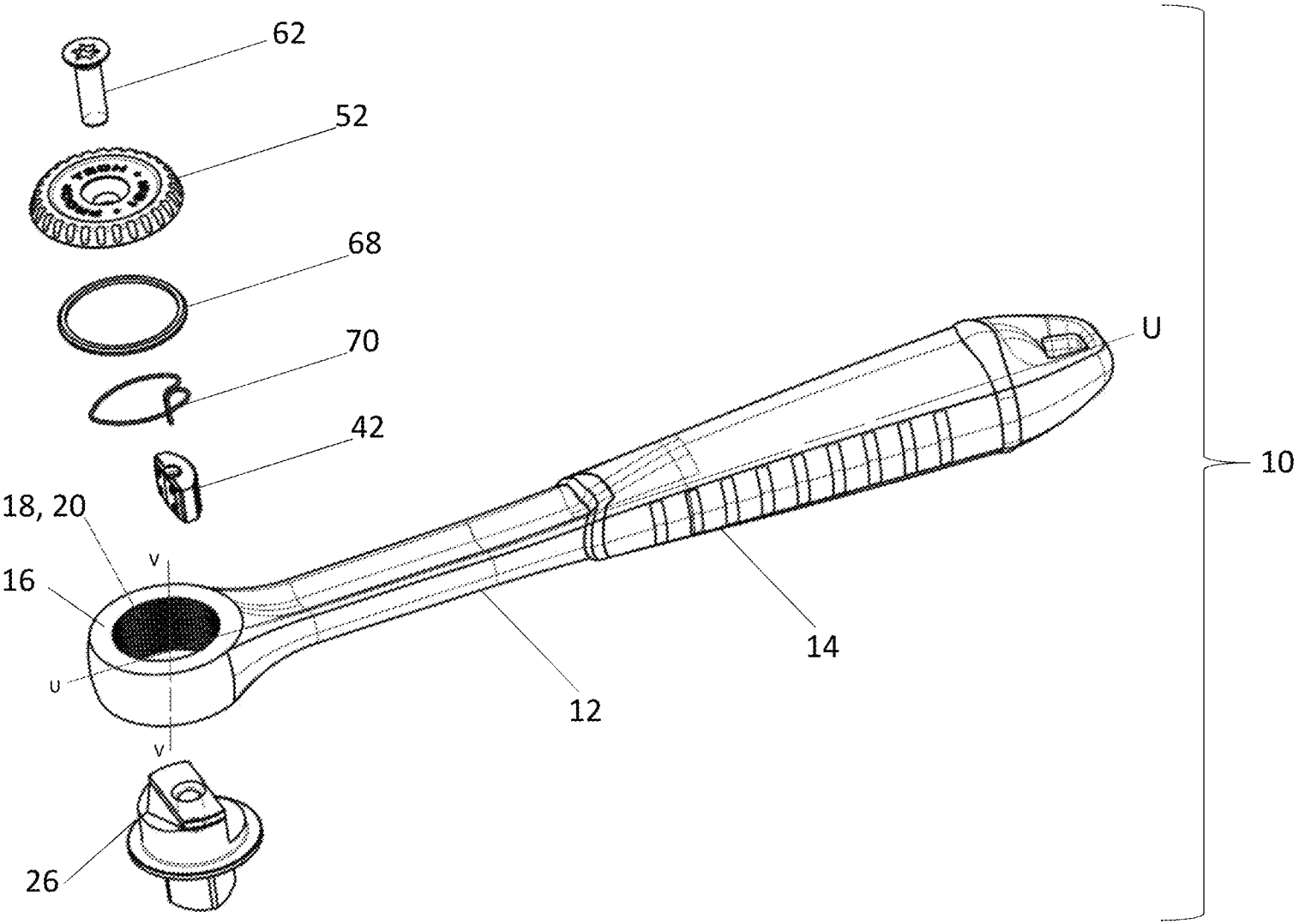
FIG. 1 shows an exploded perspective view of a reversible ratchet wrench.
Figure 2:
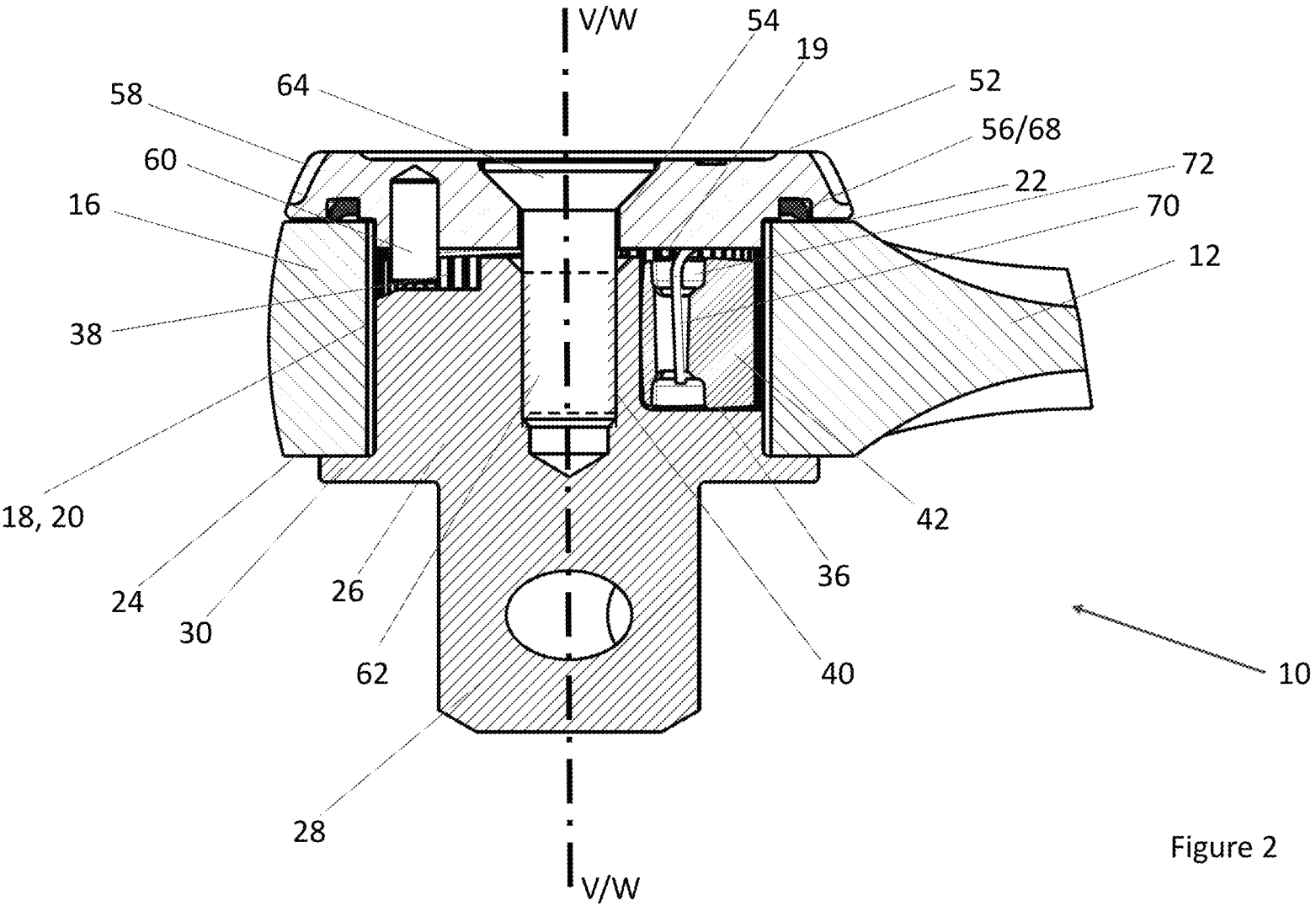
FIG. 2 shows a vertical cross-sectional view through a ratchet head of the ratchet wrench of FIG. 1.
Figure 3:
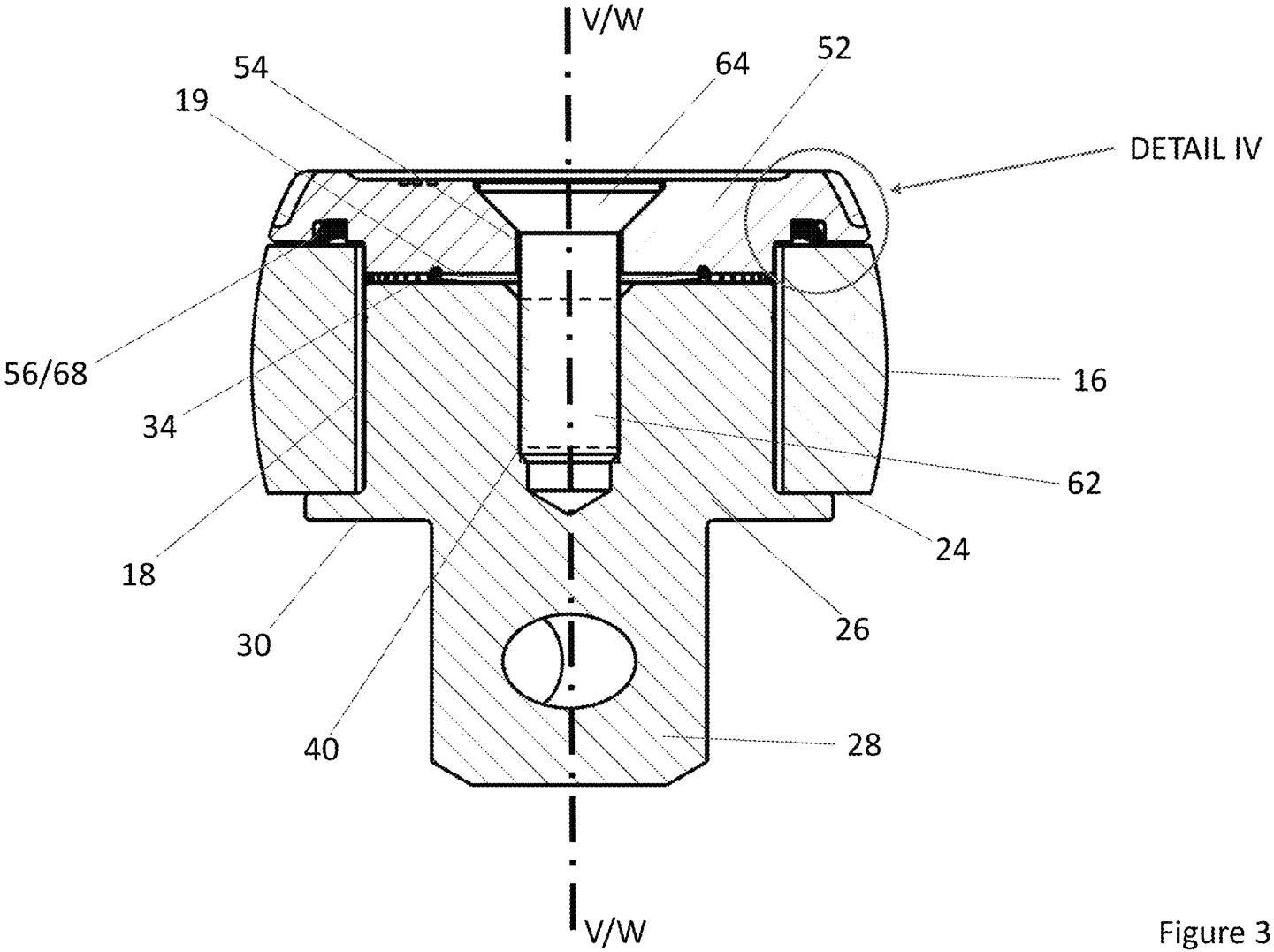
FIG. 3 shows a vertical cross-sectional view through the ratchet head orthogonal to the vertical cross-sectional view of FIG. 2.
Figure 4:
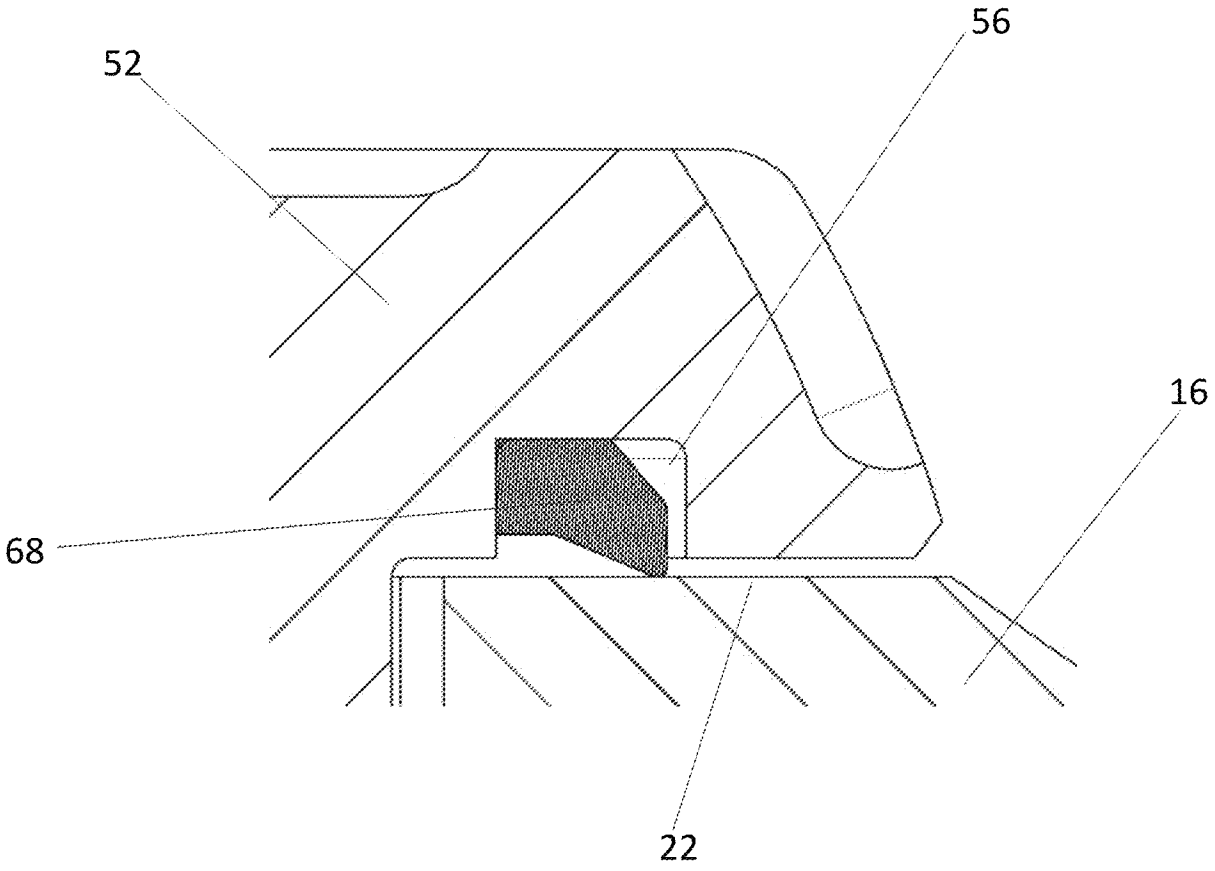
FIG. 4 shows detail IV of a cross-sectional view though a seal in the ratchet head of FIG. 3.
Figure 5:
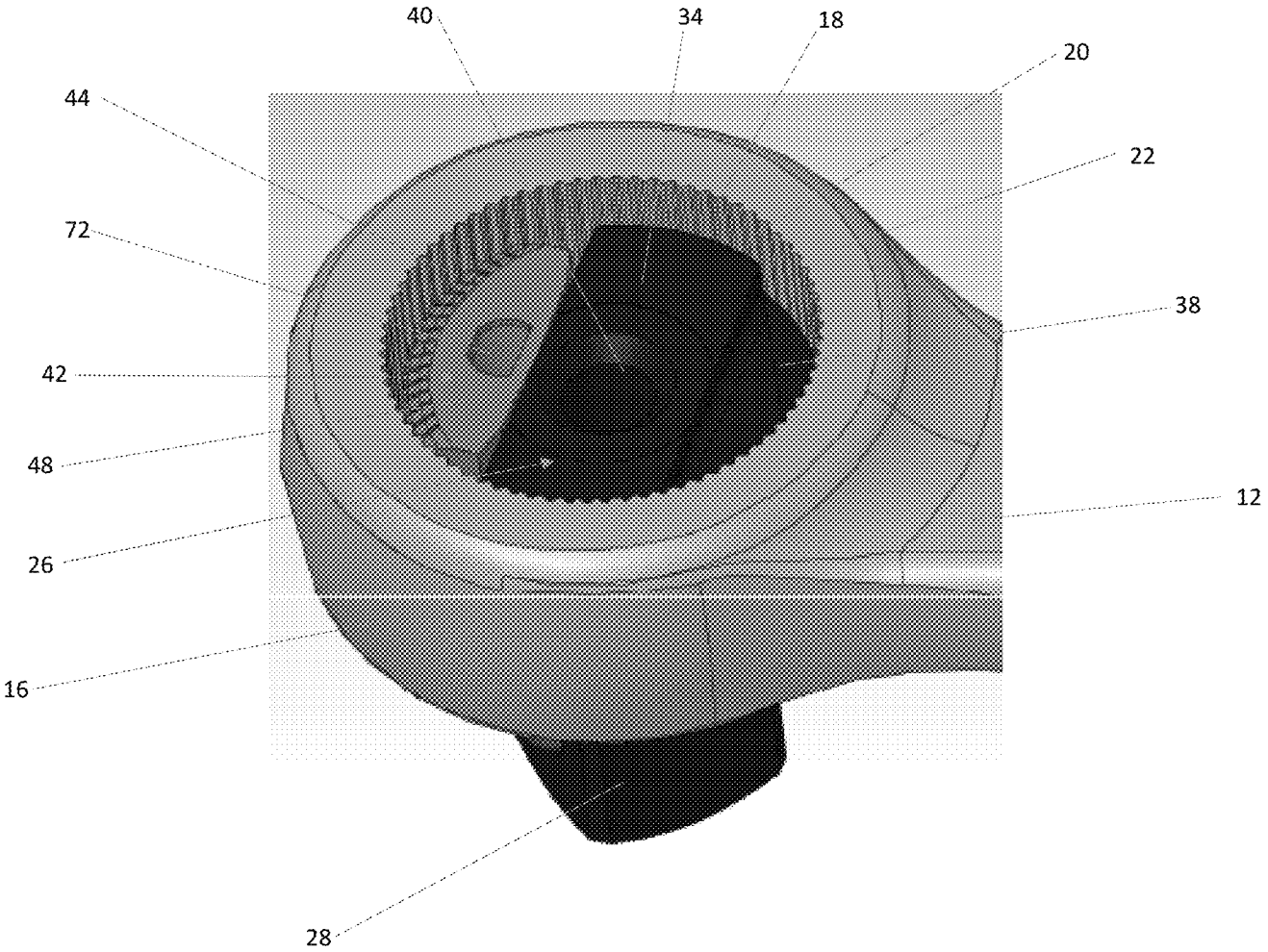
FIG. 5 shows a perspective view of inside the ratchet head of FIG. 2.
Figure 6A:
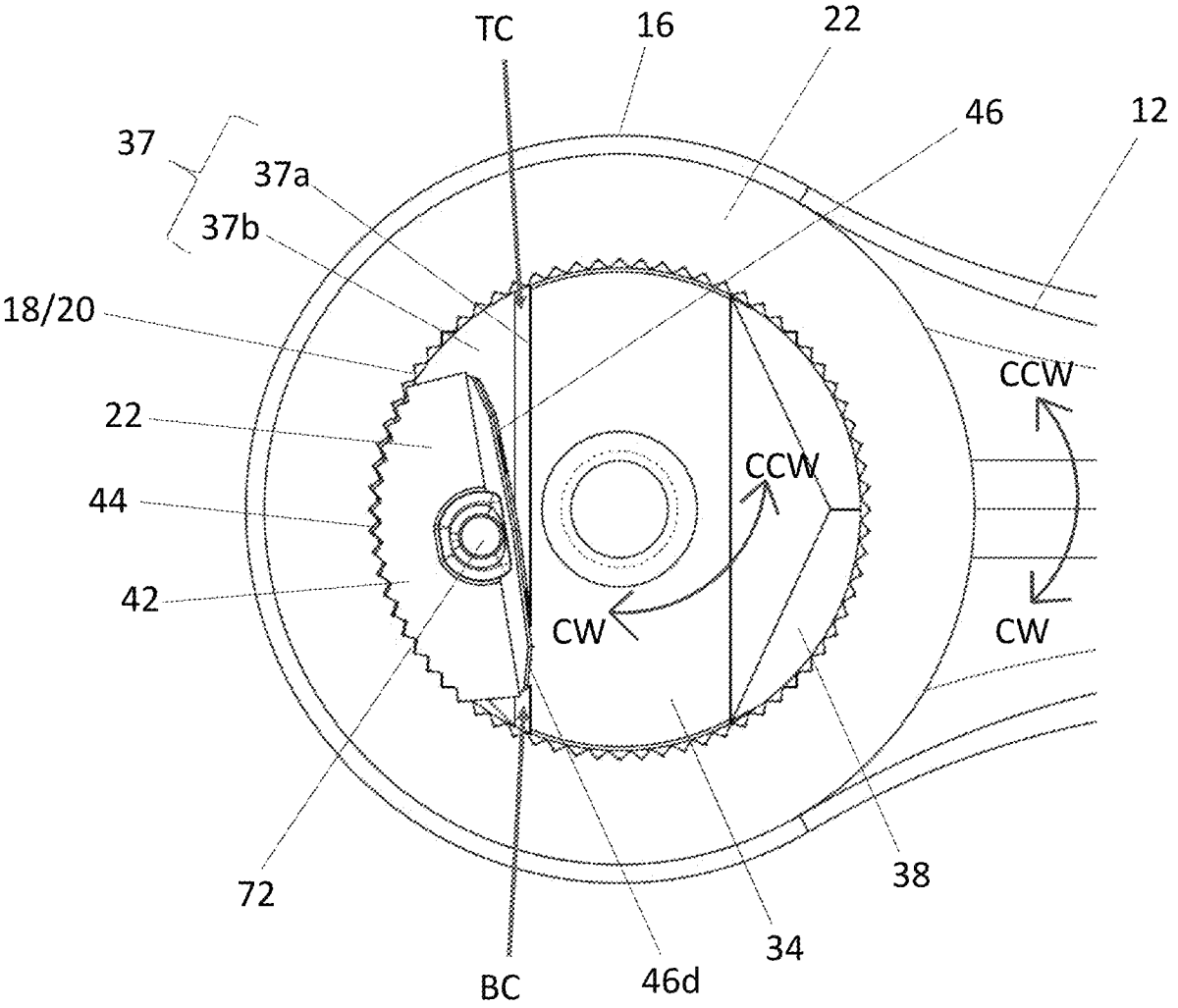
FIG. 6A shows a top view of the inside of the ratchet head of FIG. 2 arranged to transmit clockwise rotation.
Figure 6B:
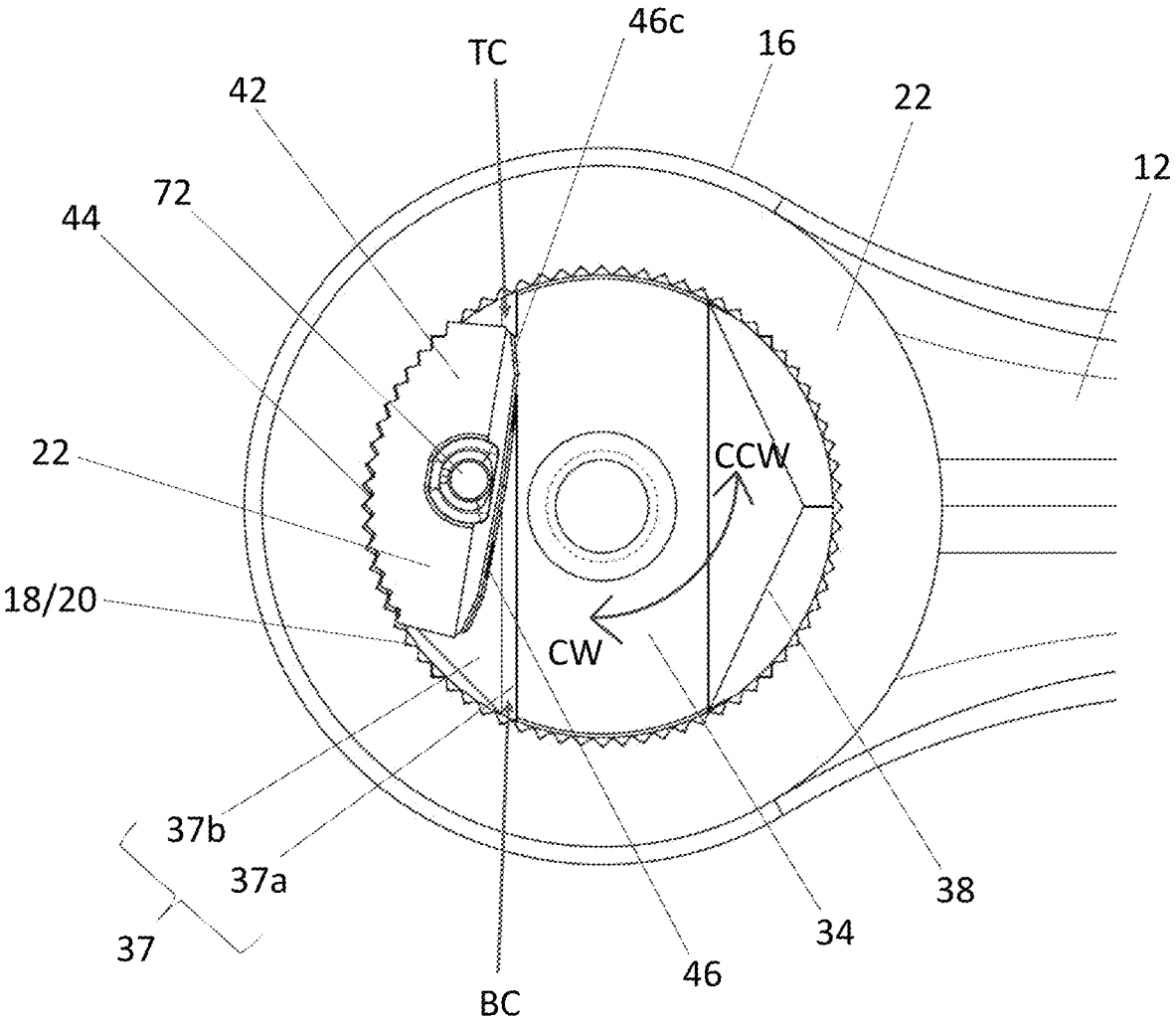
FIG. 6B shows a top view of the inside of the ratchet head of FIG. 2 arranged to transmit counter-clockwise rotation.
Figure 7:
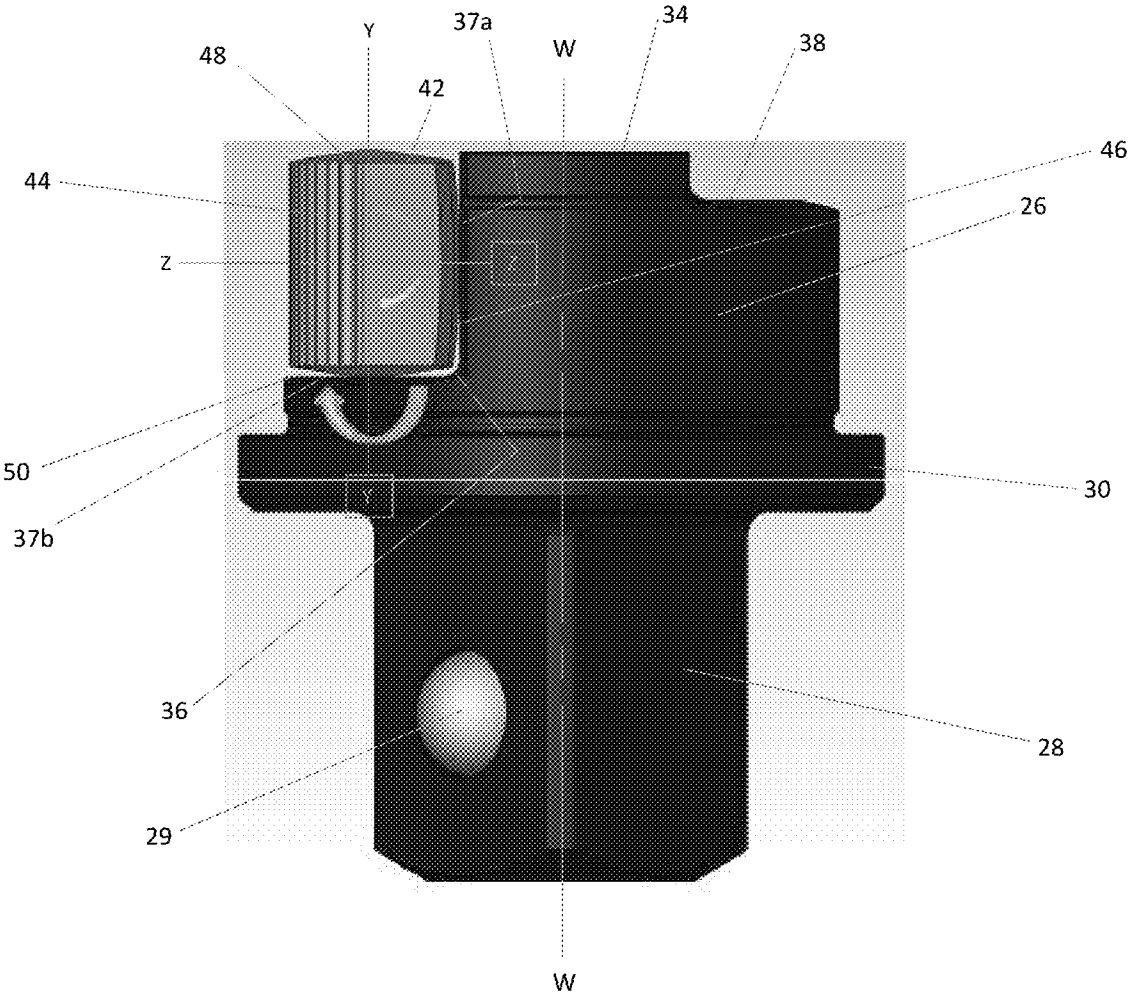
FIG. 7 shows a side elevation view of a drive member and a ratchet pawl of the ratchet head of FIG. 2.
Figures 8, 9:
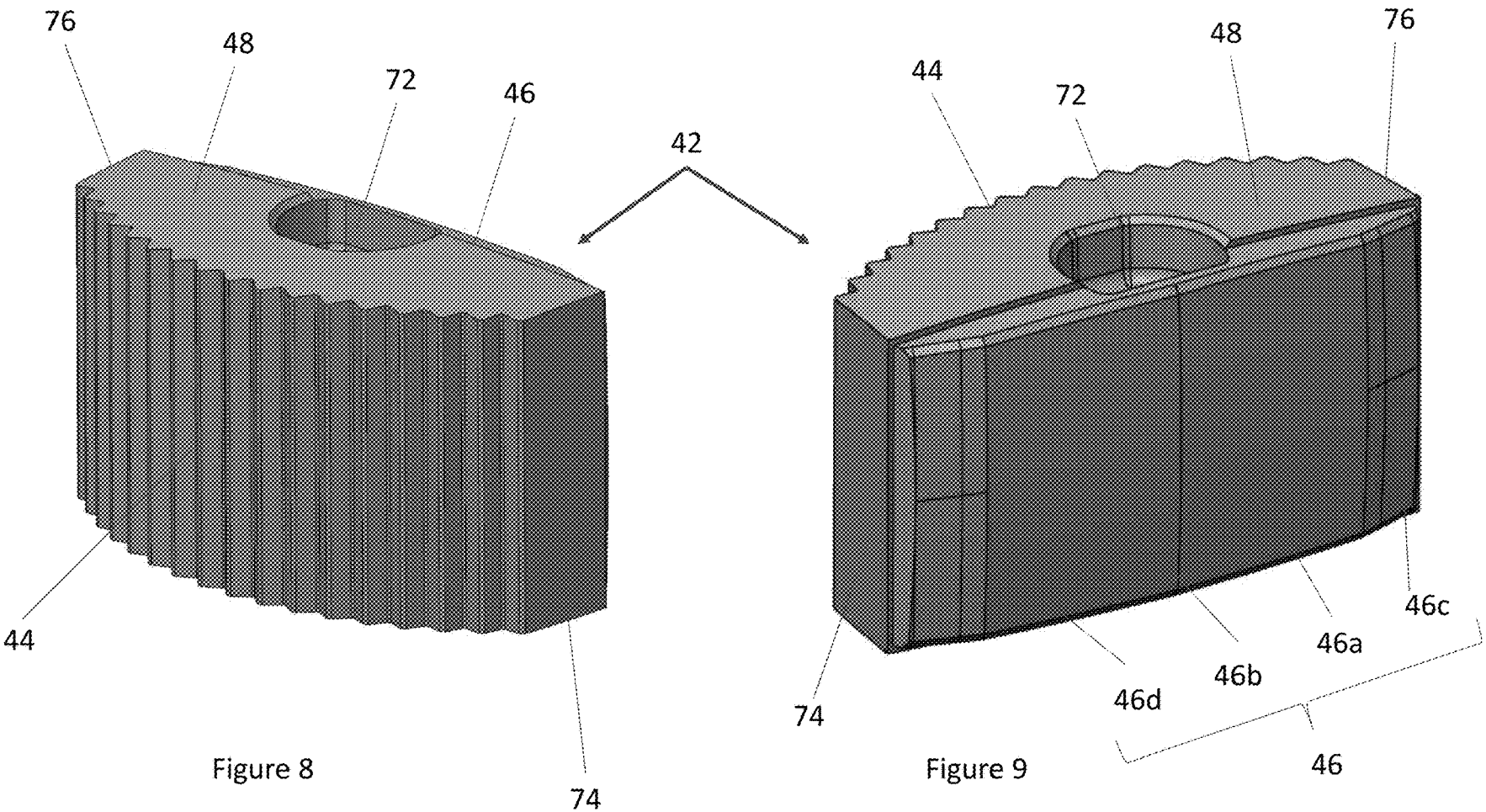
FIG. 8 shows a perspective view of an array of pawl teeth of the ratchet pawl of FIG. 7.
FIG. 9 shows a perspective view of rear pawl surface of the ratchet pawl of FIG. 7.
Figures 10, 11:
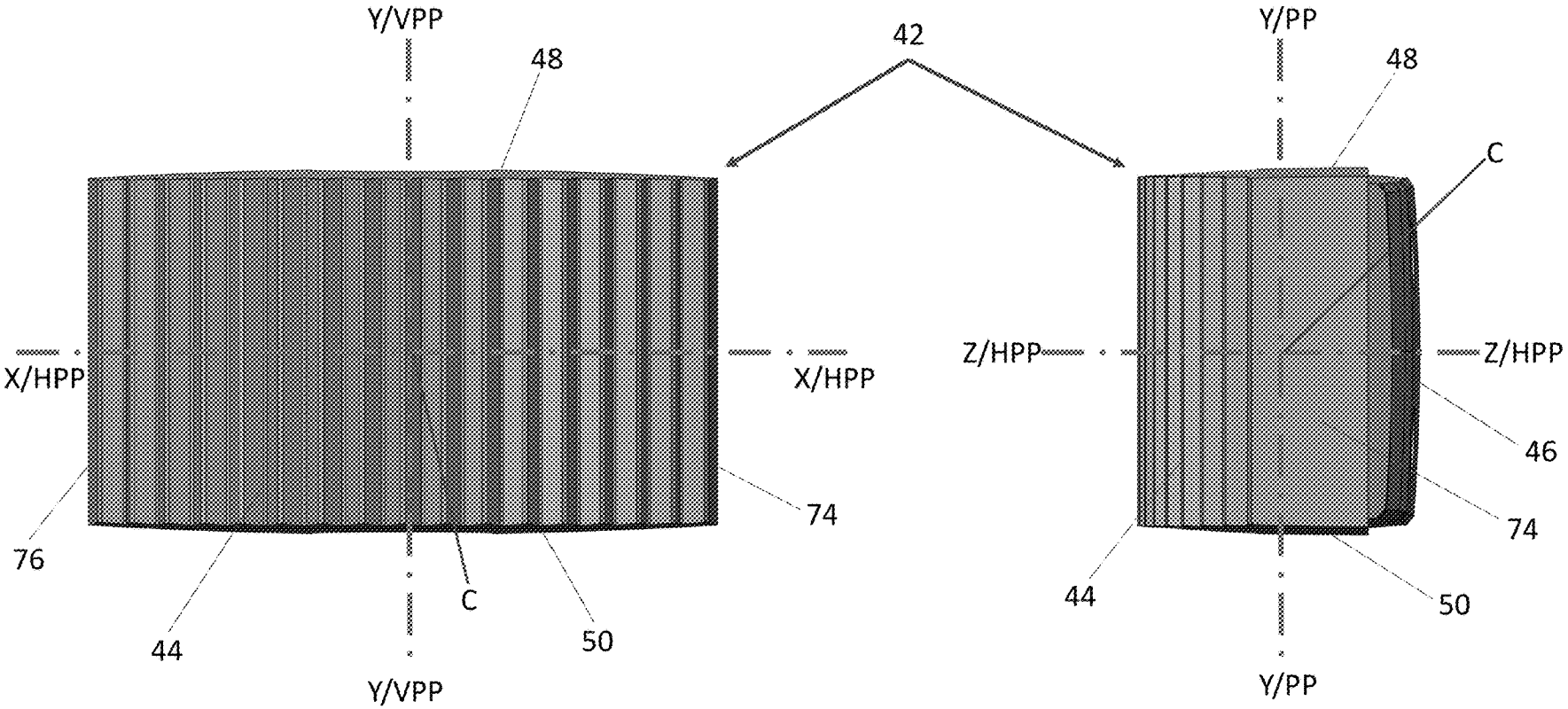
FIG. 10 shows a front elevation view of the array of pawl teeth.
FIG. 11 shows an end elevation view of an end pawl face of the ratchet pawl.

The terms "rear", "front", "upper", "lower", "top" and "bottom" used in the following description are intended mean as is shown in the FIGS. 1 to 14.

Referring to FIGS. 1 to 7, there is shown a reversible ratchet wrench 10, constructed in accordance with and embodying the features of the present invention. The ratchet wrench 10 comprises an elongate metal shaft 12 with a handle 14 at one end thereof a ring-shaped ratchet head 16 at the other opposite end thereof. The shaft 12 has a longitudinal axis U-U.

The handle 14 comprises an elongate plastic or rubber sleeve surrounding the shaft 12 to be grasped by a user of the wrench 10.

The ratchet head 16 is integral with the shaft 12. The ratchet head 16 has a central axis V-V which coincides with longitudinal axis U-U. In the present embodiment, the central axis V-V is normal to the longitudinal axis U-U. Alternatively, the central axis V-V may be inclined with respect to the longitudinal axis U-U by slightly less than 90 degrees to enable the handle 14 to be inclined away from a work surface and allow a user better access to it.

Formed through the ratchet head 16 is an enlarged cylindrical bore 18 co-axial with the central axis V-V. The bore 18 defines a generally cylindrical cavity 19 therein. Formed on the inner face of the bore 18 is a cylindrical array of ratchet teeth 20 spaced apart in equiangular intervals around the central axis V-V. The ratchet teeth 20 extend in a straight line between opposite planar annular end faces 22, 24 of the ratchet head 16. Both annular end faces 22, 24 are substantially normal to the central axis V-V.

Retained coaxially in the bore 18 for rotation about the central axis V-V relative to the ratchet head 16 is a drive member 26 comprising a square drive spindle 28 integral with the drive member 26 at one lower end thereof and projecting axially for engagement with a complementary driven accessory tool (not shown) like, for example, a socket. The drive member 26 and its drive spindle 28 have a central rotation axis W-W which, in normal working conditions, is coaxial with the central axis V-V of the ratchet head 16 in which the drive member 26 is arranged. One side of the drive spindle 28 is equipped with a retractable detent ball 29 which is biased to protrude a small way from the drive spindle 28 for removable engagement with a driven tool, in a manner which is also well known to the skilled addressee.

The drive member 26 comprises a radially outwardly extending annular shoulder 30 having an outer diameter greater than the circular bore 18 so that the annular shoulder 30 faces, and may slide against, the lower end face 24 of the ratchet head 16. The annual shoulder 30 is coaxial with the rotation axis W-W of the drive member 26.

The drive member 26 comprises an upper face 34 integral with the drive member 26 and located at the other axial upper end thereof opposite the drive spindle 28. The drive member 26 is dimensioned so that the upper face 34 is disposed axially inwardly from the annular upper end face 22 when the annular shoulder 30 faces the annular lower end face 24 of the ratchet head 16.

Formed in the upper face 34 of the drive member 26 is a pawl recess 36 extending part-way down one side of the drive member 26 towards the annular shoulder 30. The pawl recess 36 comprises a planar recess back 37*a*, parallel to the central axis W-W of the drive member 26, and a planar recess seat 37*b*, normal to the rotation axis W-W of the drive member 26.

Formed in the upper face 34 of the drive member 36, on an opposite side of the rotation axis W-W to the pawl recess 36, is a shallower pin recess 38. Also formed on the upper face 34 of the drive member 26, intermediate the pawl recess 36 and the pin recess 38, is a threaded blind bore 40. The blind bore 40 is substantially coaxial with the rotation axis W-W of the drive member 26.

Supported upon the pawl recess 36 is a pawl 42. Formed on a front side of the pawl 42 is an arcuate array of pawl teeth 44 facing, and dimensioned for meshing engagement with, the ratchet teeth 20 of the cylindrical bore 18. Formed on the opposite rear side of the pawl 42 to the pawl teeth 44 is a rear surface 46 having convex portions and being dimensioned for sliding engagement with the recess back 37*a* of the pawl recess 36.

The pawl teeth 44 extend in a straight line between smooth, slightly convex upper 48 and lower 50 surfaces of the pawl 42 as does the pawl rear surface 46. This is described in more detail below.

The ratchet wrench 10 comprises a switching cap 52, generally in the shape of a circular disk with a though hole 54. Formed on a lower face of the switching cap 52, facing the upper end face 22 of the ratchet head 16, is an annular recess 56. The through hole 54 and the annular recess 56 are coaxial with the rotation axis W-W. Protruding from an upper surface of the switching cap 52 is an operation rib 58 for manipulation by a user of the ratchet wrench 10. Protruding from the lower face of the switching cap 52, and spaced radially outwardly from the through hole 54, is a pin 60, which is preferably integral with the switching cap 52. The switching cap 52 is located on the drive member 26. The pin 60 is received in the pin recess 38 of the drive member 26. The though hole 54 is axially aligned with the blind hole 40.

A screw 62 with a countersunk head 64, is rotatingly received in the through hole 54 and is threadingly engaged with the blind hole 40. The screw 62 mates the reversing cap 52 with the drive member 26. Annular seal 68 seated in the annular recess 56 of the reversing cap 52 cushions the ratchet head 16 between the switching cap 52 and the drive member 26. The annular seal 68 is formed of a suitable flexible and resilient material to exert sealing forces in axial directions for sealing lubricant in the cavity 19 and for preventing the entry of dirt while at the same time not exerting too much rotational drag on the assembled parts. The enlarged countersunk head 64 retains the parts of the ratchet wrench 10 in an assembled condition.

Protruding from the lower face of the switching cap 52, on a diametrically opposite side of the through hole 54 to the pin 60, is a spur 70 which is resiliently coupled to the switching cap 52 for rotation therewith. The spur 70 is received in a notch 72 in the upper pawl surface 48 of the pawl 42. The spur 70 is arranged to couple rotation of the switching cap 52 to the pawl 42 via the pawl notch 72.

The switching cap 52 is rotatable in relation to the drive member 26 a short way in either a clockwise CW, or a counter-clockwise CCW, direction, about the rotation axis W-W, and according to movement of the pin 60 within the confines of the pin recess 38.

When the switching cap 52 is manipulated by a user to move in a clockwise counter-direction CCW about the rotation axis W-W, the pawl 42 slides along the pawl recess 36 together with the switching cap 52 by virtue of engagement between the spur 70 and the pawl notch 72. Here, the pawl 42 is disposed where rotation of the handle 14 in a clockwise direction CW about the central axis V-V will tend to wedge the pawl 42 in a bottom corner BC (as viewed from above in FIG. 6A) between the bore 18 and recess back 37*a*. The spur 70 urges the pawl 42 towards the bottom corner BC which encourages the ratchet teeth 20 to mesh with the pawl teeth 44. The meshed teeth 20, 44 transmit rotation of the handle 14 into clockwise direction CW of the drive member 26 and, by connection, to an accessory tool coupled to the drive spindle 28. In a return stroke of the handle 14 in a counter-clockwise direction CCW, the ratchet teeth 20 will tend to move the pawl teeth 44 and the pawl 42 away from the bottom corner BC. Natural resilience in the spur 70 allows the pawl teeth 44 to un-mesh and ride over the ratchet teeth 20. Rotation of the handle 14 in the counter-clockwise direction CCW is decoupled from the drive member 26 to cause lost motion as the drive spindle 28 and the accessory tool coupled thereto remain stationary. The switching cap 52 is retained in the 'tightening position' by a spring-loaded detent (not shown).

The switching cap 52 may be manipulated by a user to move in a clockwise direction CW about the central axis V-V to reverse operation of the ratchet wrench 10. The pawl 42 slides from the bottom corner BC along the pawl recess 36 together with the switching cap 52 by virtue of engagement between the spur 70 and the pawl notch 72. Here, the pawl 42 is disposed where rotation of the handle 14 in a counter-clockwise direction CCW about the central axis V-V will tend to wedge the pawl 42 in a top corner TC (as viewed from above in FIG. 6B) between the bore 19 and recess back 37*a*. Again, the spur 70 urges the pawl 42 towards the top corner TC which encourages the ratchet teeth 20 to mesh with the pawl teeth 44. The meshed teeth 20, 44 transmit rotation of the handle 14 into counter-clockwise direction CCW of the drive member 26 and, by connection, to an accessory tool coupled to the drive spindle 28. In a return stroke of the handle 14 in a clockwise direction CW, the ratchet teeth 20 will tend to move the pawl teeth 44 and the pawl 42 away from the top corner TC. Natural resilience in the spur 70 allows the pawl teeth 44 to un-mesh and ride over the ratchet teeth 20. Rotation of the handle 14 in the clockwise direction CW is decoupled from the drive member 26 to cause lost motion as the drive spindle 28 and the accessory tool coupled thereto remain stationary. The switching cap 52 is retained in the 'loosening position' by the spring-loaded detent (not shown).

The user can continue to perform a loosening operation. Alternatively, the user may manipulate the switching cap 52 to move it in a clockwise direction CW to perform a tightening operation.

The presence of the annular seal 68 at the various moving parts of the ratchet wrench 10 improves resistance to ingress of dirt into the cylindrical bore 18 which would otherwise impair performance over time. However, the annular seal 68 may introduce additional play between the switching cap 52 and the annular upper end face 22 of the ratchet head 16 and between the annular shoulder 30 of the drive member 26 and the lower end face 24 of the ratchet head 16 that would not be present with metal-to-metal contact. In use, when the handle 14 is turned, and torque is transmitted to an accessory tool coupled to the drive spindle 28, the drive member 26 may tilt in relation to the ratchet head 16. This may cause a divergence between the central axis W-W of the drive member 26 and the central axis V-V of the ratchet head 16.

Referring to FIGS. 8 to 14, the pawl 42 is a three-dimensional solid metal body having a three mutually orthogonal axes: a horizontal axis X-X, a vertical axis Y-Y and a third axis Z-Z which intersect each other at the centre C of the pawl 42. The vertical axis Y-Y traverses the upper 48 and lower 50 pawl surfaces and is parallel to the pawl teeth 44. The horizontal axis X-X spans the major dimension of the pawl 42 and it traverses the end pawl faces 74, 76. The third axis Z-Z traverses the pawl teeth 44 and the rear pawl surface 46 and is co-planar with the horizontal axis X-X. The pawl 42 has a vertical pawl plane VPP of symmetry comprising the Y-Y and Z-Z axes. The end pawl faces 74, 76 are planar and parallel to the vertical pawl plane VPP and the pawl teeth 44. The pawl 42 has a horizontal pawl plane HPP of symmetry comprising the X-X and Z-Z axes.

As mentioned above, the rear pawl surface 46 is has, in respect of a pawl plane PP comprising the horizontal X-X and vertical Y-Y axes, convex portions. The rear pawl surface 46 comprises a pair of central rear pawl cheeks 46*a*, 46*b* arranged on opposite sides of the vertical pawl plane VPP. The rear pawl face 46 comprises a pair of outer rear pawl cheeks 46*c*, 46*d*, one arranged outside each of the central rear pawl cheeks 46*a*, 46*b*.

Figure 12:
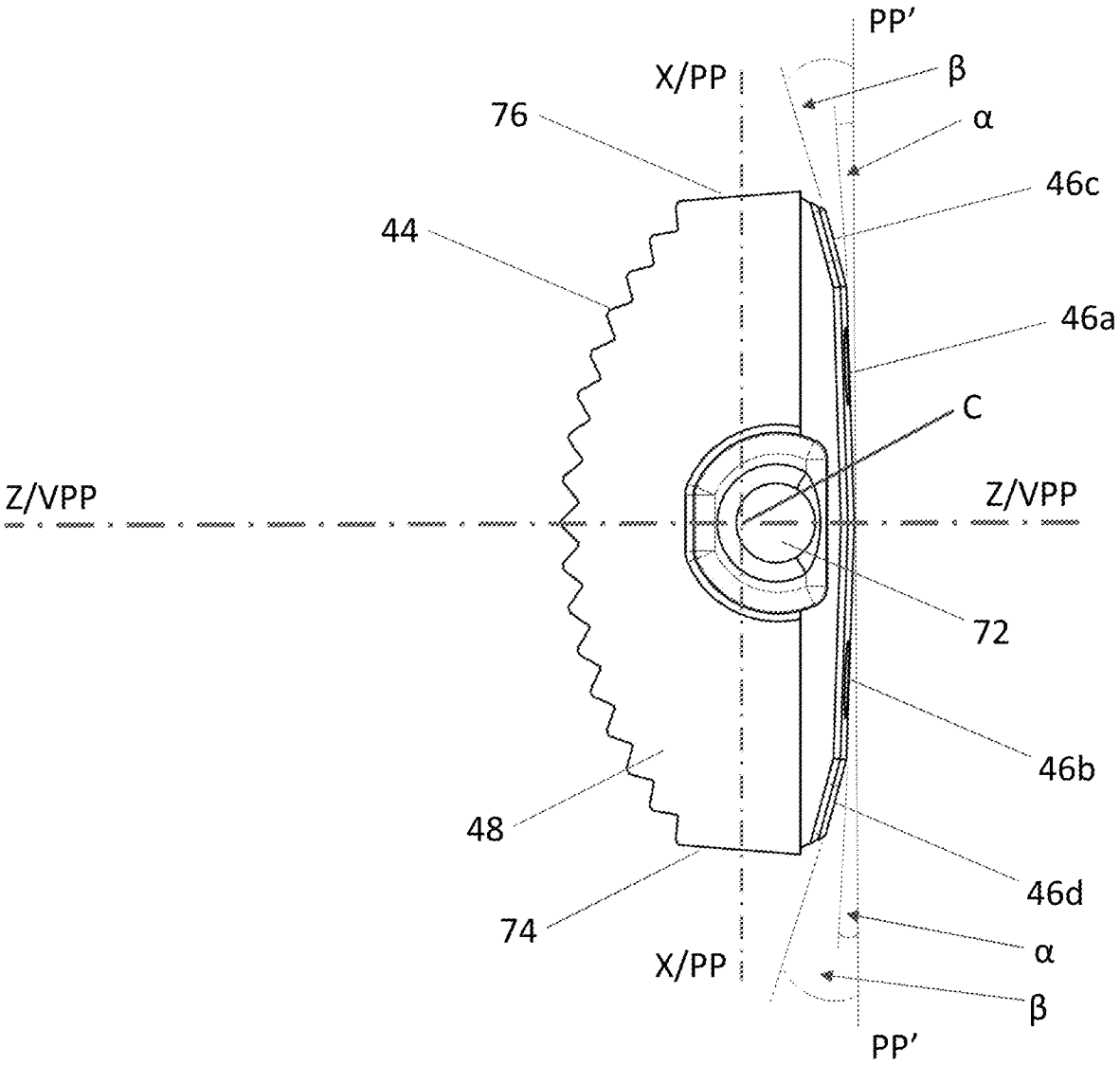
FIG. 12 is a top view of the ratchet pawl with angles of portions of the rear pawl surface indicated.

Referring in particular to FIG. 12, in the horizontal pawl plane HPP, the central rear pawl cheeks 46*a*, 46*b* and the outer rear pawl cheeks 46*c*, 46*d* all have a flat profile which is inclined in relation to a front pawl plane PP' parallel to the pawl plane PP. The flat profile of each central rear pawl cheek 46*a*, 46*b* is inclined towards the pawl teeth 44 by a central angle of inclination $\alpha$ of 1.9 degrees in respect to the front pawl plane PP'. The flat profile of each outer rear pawl cheek 46*c*, 46*d* is inclined towards the pawl teeth 44 by an outer angle of inclination $\beta$ of 15.5 degrees in respect to the front pawl plane PP' (starting from a respective adjacent central rear pawl cheek 46*a*, 46*b*). As such, in the horizontal pawl plane HPP the rear pawl surface 46 comprises a convex array of flat profiles extending between the pawl ends faces 74, 76.

Figure 13:
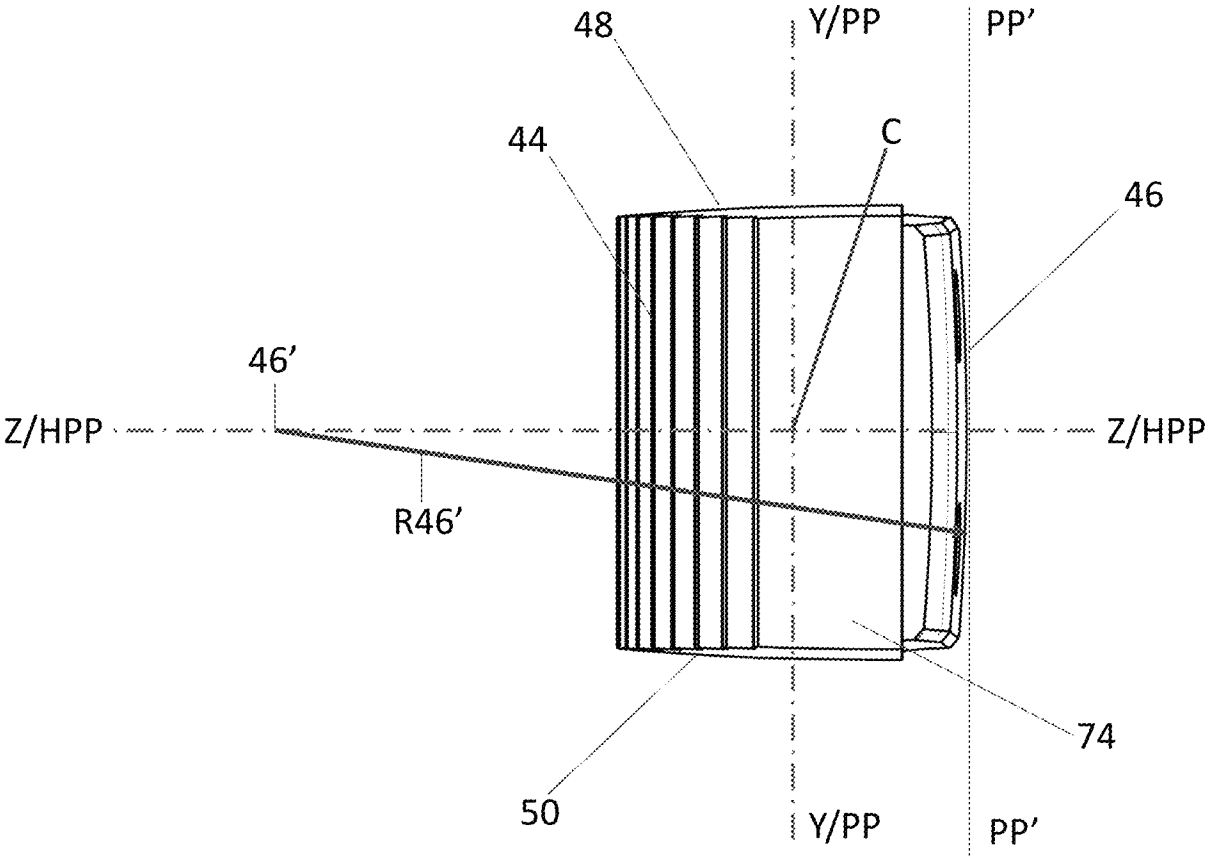
FIG. 13 is a side elevation view of the ratchet pawl with dimensions indicated.
Figure 14:
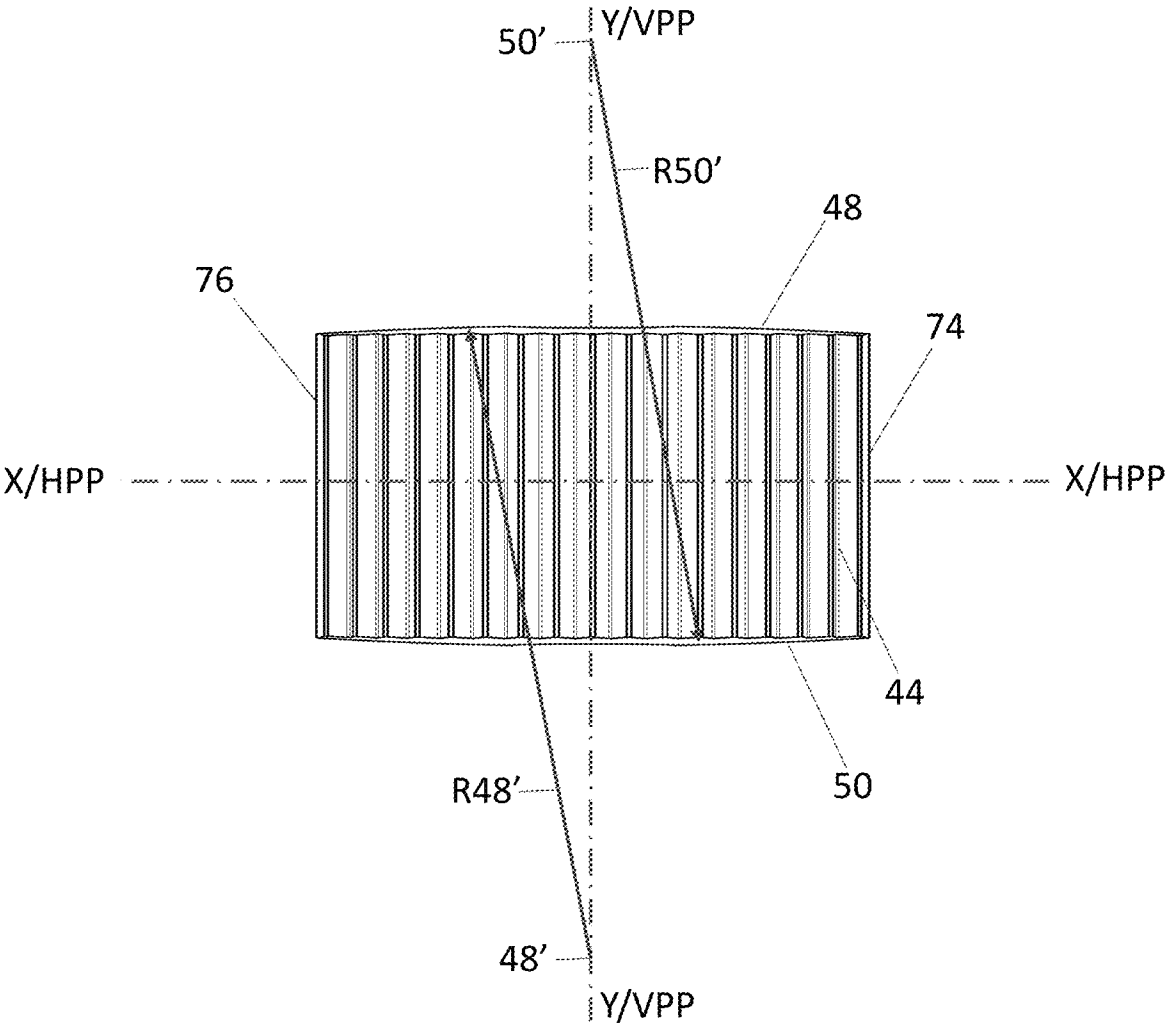
FIG. 14 is a front elevation view of the ratchet pawl with dimensions indicated.

Referring in particular to FIGS. 13 and 14, the central rear pawl cheeks 46*a*, 46*b* and the outer rear pawl cheeks 46*c*, 46*d* are convex in respect of the vertical pawl plane VPP. A radius R46' of convexity of the central rear pawl cheeks 46*a*, 46*b* and the outer rear pawl cheeks 46*c*, 46*d* varies according to the size of the ratchet wrench 10. In the case of a ratchet wrench with a quarter inch or a three-quarter inch drive spindle 28, for example, the radius R46' of convexity is approximately 50 mm measured from a point 46' on the axis Z-Z. In the case of a ratchet wrench with a half-inch drive spindle 28, for example, the radius R46' of convexity is approximately 60 mm measured from a point 46' on the axis Z-Z. As such, in the vertical pawl plane VPP the rear pawl surface 46 comprises a convex profile extending between the upper 48 and lower 50 pawl faces.

The upper 48 and lower 50 pawl faces are convex in respect of the pawl plane PP and the vertical pawl plane VPP. A radius R48' of convexity of the upper pawl face 48 varies according to the size of the ratchet wrench 10. In the case of a ratchet wrench with a quarter inch or a three-quarter inch drive spindle 28, for example, the radius R48' of convexity of the upper pawl face 48 is approximately 71.2 mm measured from a point 48' on the vertical axis Y-Y. In the case of a ratchet wrench with half inch drive spindle 28, for example, the radius R48' of convexity of the upper pawl face 48 is approximately 143.5 mm measured from the point 48'. Likewise, the radius R50' of convexity of the lower pawl face 50 varies according to the size of the ratchet wrench 10. In the case of a ratchet wrench with a quarter inch or a three-quarter inch drive spindle 28, for example, the radius R50' of convexity of the lower pawl face 50 is approximately 71.2 mm measured from a point 50' on the vertical axis Y-Y. In the case of a ratchet wrench with half inch drive spindle 28, for example, the radius R50' of convexity of the lower pawl face 50 is approximately 143.5 mm measured from the point 50'. For a given size of ratchet wrench 10, radii R48', R50' are substantially the same because, aside from the presence of the pin recess 38 in the upper pawl face 48, the pawl 42 is symmetrical about the horizontal pawl plane HPP.

Returning to FIG. 6A, when the pawl 42 is wedged in the bottom corner BC, the outer rear pawl cheek 46*d* contacts the pawl recess 37 with the pawl plane PP inclined by the outer angle of inclination $\beta$ in respect to the recess back 37*a*. The flat profile of the outer rear pawl cheek 46*d* (in the horizontal plane HPP) assists stability between the pawl teeth 44 and the ratchet teeth 20 in the direction of clockwise rotation CW while the convexity of the outer rear pawl cheek 46*d* (in the vertical plane VPP) may allow for a small amount of tilting movement of the drive member 26 causing misalignment between its rotation axis W-W and the central axis V-V of the ratchet head 16.

Likewise, and returning to FIG. 6B, when the pawl 42 is wedged in the top corner TC, the outer rear pawl cheek 46*c* contacts the pawl recess 37 with the pawl plane PP inclined by the outer angle of inclination $\beta$ in respect to the recess back 37*a*. The flat profile of the outer rear pawl cheek 46*c* (in the horizontal plane HPP) assists stability between the pawl teeth 44 and the ratchet teeth 20 in the direction of counter-clockwise rotation CCW while the convexity of the outer rear pawl cheek 46*d* (in the vertical plane VPP) may allow for a small amount of tilting movement of the drive member 26 causing misalignment between its rotation axis W-W and the central axis V-V of the ratchet head 16.

Returning to FIGS. 2 and 7, support interfaces between the pawl 42 and the pawl recess 36 are defined, in the vertical direction, by the at least partially convex rear pawl surface 46 and the planar recess back 37*b* and, in the horizontal direction, by the convex lower pawl surface 50 and the planar recess seat 37*b*. As mentioned above, the convexity of the pawl surfaces 46, 50 allows some degree of relative movement between the pawl 42 and the drive member 26 whilst the pawl teeth 44 may remain parallel with the ratchet teeth 20. This allows for any geometric manufacturing inaccuracies and/or tilting movement of the drive member 26 which could cause misalignment between its rotation axis W-W and the central axis V-V of the ratchet head 16. This diminishes wear at the interfaces between the ratchet teeth 20 and the pawl teeth 44, on the one hand, and the pawl 42 and the pawl recess 36, on the other hand, whilst maintaining satisfactory ratcheting operation of the ratchet wrench 10.

The invention claimed is:

1. A ratchet wrench (10) comprising:

a ring-shaped ratchet head (16) with a cylindrical bore (18) having a central axis (V-V);

a handle (14) coupled to the ratchet head (16) for movement therewith;

a drive member (26) with a rotation axis (W-W) retained within the cylindrical bore for rotation about the central axis (V-V);

a cylindrical array of straight ratchet teeth (20) arranged about one of the cylindrical bore or the drive member and parallel to the axis (V-V, W-W) thereof;

a toothed ratchet pawl (42), wherein at least one partially convex pawl surface comprises a partially convex rear pawl surface (46) with partially planar cheeks (46*c*, 46*d*) arranged to stabilize meshed engagement between the pawl (42) and the ratchet teeth (20) in a plane (HPP) normal to the rotation axis (W-W);

a manually operable switching member having an upper surface configured for user manipulation, wherein the switching member is located on the driver member and coupled to the pawl for selective orientation of the pawl for; and a pawl recess (36) arranged to support the pawl for either:

meshed engagement with the ratchet teeth for transmission of rotation of the handle about the central axis (V-V) in a first direction (CW, CCW) to the drive member about the rotation axis (W-W); or disengagement from the ratchet teeth to decouple rotation of the handle about the central axis (V-V) in a second direction (CCW, CW) opposite to the first direction from the drive member, wherein support (37*a*, 37*b*, 46, 48, 50) for the pawl (42) in the recess (36) is configured to accommodate divergence between the central axis (V-V) and the rotation axis (W-W).

2. A ratchet wrench (10) as claimed in claim 1, wherein the at least one pawl surface comprises a convex lower pawl surface (50) intermediate the rear pawl surface (46) and the at least one straight pawl tooth (44).

3. A ratchet wrench (1) as claim in claim 1, wherein the at least one pawl surfaces comprises a convex upper pawl surface (48) on an opposite side of the pawl (42) to the lower pawl surface (50).

4. A ratchet wrench (10) comprising:

a ring-shaped ratchet head (16) with a cylindrical bore (18) having a central axis (V-V);

a handle (14) coupled to the ratchet head (16) for movement therewith;

a drive member (26) with a rotation axis (W-W) retained within the cylindrical bore for rotation about the central axis (V-V);

a toothed ratchet pawl (42);

a cylindrical array of straight ratchet teeth (20) arranged about one of the cylindrical bore or the drive member and parallel to the axis (V-V, W-W) thereof;

a pawl recess (36) arranged to support the pawl for either:

meshed engagement with the ratchet teeth for transmission of rotation of the handle about the central axis (V-V) in a first direction (CW, CCW) to the drive member about the rotation axis (W-W); or disengagement from the ratchet teeth to decouple rotation of the handle about the central axis (V-V) in a second direction (CCW, CW) opposite to the first direction from the drive member, wherein support (37*a*, 37*b*, 46, 48, 50) for the pawl (42) in the recess (36) is configured to accommodate divergence between the central axis (V-V) and the rotation axis (W-W); and wherein the ratchet wrench is a reversible ratchet wrench (10) comprising a manually operable switching member (52) having an upper surface configured for user manipulation, wherein the switching member is located on the driver member and coupled to the pawl (42) for selective orientation of the pawl between:

a first orientation wherein the pawl is arranged to mesh with the ratchet teeth (20) when the handle is rotated about the central axis (V-V) in the first direction (CW) thereby transmitting first direction rotation to the drive member and wherein the pawl is arranged to ride over the ratchet teeth (20) when the handle is rotated about the central axis (V-V) in the second direction (CCW) thereby disengaging the drive member from second direction rotation of the handle; and a second orientation wherein the pawl is arranged to mesh with the ratchet teeth (20) when the handle is rotated about the central axis (V-V) in the second direction (CCW) thereby transmitting second direction rotation to the drive member and wherein the pawl is arranged to ride over the ratchet teeth (20) when the handle is rotated about the central axis (V-V) in the first direction (CW) thereby disengaging the drive member from first direction rotation of the handle.

5. A ratchet wrench (10) as claimed in claim 4, wherein the bore (18) is sealed by a seal (68) arranged between the switching member (52) and the head (16).

6. A ratchet wrench (10) as claimed in claim 4, wherein the switching member (52) is releasably retained in either of the first or second orientations of the pawl (42).

7. A ratchet wrench (10) as claimed in claim 4, wherein the switching member (52) is releasably retained in either of the first or second orientations of the pawl (42).

* * * * *